US010311796B2

(12) United States Patent
Shi

(10) Patent No.: US 10,311,796 B2
(45) Date of Patent: Jun. 4, 2019

(54) SCAN DRIVING CIRCUIT AND DISPLAY DEVICE

(71) Applicant: Shenzhen China Star Optoelectronics Semiconductor Display Technology Co., Ltd., Shenzhen, Guangdong (CN)

(72) Inventor: Longqiang Shi, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/557,448

(22) PCT Filed: Aug. 22, 2017

(86) PCT No.: PCT/CN2017/098438
§ 371 (c)(1),
(2) Date: Sep. 11, 2017

(87) PCT Pub. No.: WO2019/010756
PCT Pub. Date: Jan. 17, 2019

(65) Prior Publication Data

US 2019/0019461 A1 Jan. 17, 2019

(30) Foreign Application Priority Data

Jul. 11, 2017 (CN) ..... 2017 1 0561972

(51) Int. Cl.
*G09G 3/3266* (2016.01)
*G09G 3/36* (2006.01)
*G09G 3/20* (2006.01)

(52) U.S. Cl.
CPC ..... *G09G 3/3266* (2013.01); *G09G 3/3674* (2013.01); *G09G 2310/0297* (2013.01); *G09G 2310/06* (2013.01); *G09G 2310/08* (2013.01)

(58) Field of Classification Search
CPC ... G09G 2300/0804; G09G 2300/0871; G09G 2310/0232; G09G 2310/0248;
(Continued)

(56) References Cited

U.S. PATENT DOCUMENTS

2015/0221265 A1* 8/2015 Huang ..... G09G 3/3614 345/690
2017/0025079 A1* 1/2017 Feng ..... G11C 19/28
(Continued)

*Primary Examiner* — Kwin Xie
(74) *Attorney, Agent, or Firm* — Andrew C. Cheng

(57) ABSTRACT

Provided are a scan driving circuit and a display device. Each driving unit comprises a first signal input end receiving a trigger signal or a former stage scan signal, a second signal input end receiving a latter stage scan signal, a first signal output end and a second signal output end connected to a multiplexing circuit; each multiplexing unit comprises a first signal receiving end and a second signal receiving end respectively connected to the first signal output end and the second signal output end, a third signal receiving end receiving the former stage scan signal, a fourth signal receiving end receiving the latter stage scan signal, a fifth signal receiving end receiving a clock signal, a scan signal output end outputting a scan signal for simplifying the circuit and saving the space, which is beneficial for the narrow frame design of the display device.

9 Claims, 4 Drawing Sheets

(58) Field of Classification Search
CPC ... G09G 2310/0267; G09G 2310/0286; G09G 2310/04; G09G 2310/08; G09G 3/2092; G09G 3/3266
See application file for complete search history.

(56) References Cited

U.S. PATENT DOCUMENTS

2017/0061855 A1* 3/2017 Tsai ..... G09G 3/2092
2018/0047328 A1* 2/2018 Kim ..... G09G 3/2092

* cited by examiner

SCAN DRIVING CIRCUIT AND DISPLAY DEVICE

FIELD OF THE INVENTION

The present invention relates to a display field, and more particularly to a scan driving circuit and a display device.

BACKGROUND OF THE INVENTION

GOA (Gate Driver on Array) is conducive to the display screen narrow frame design and cost reduction, thus is widely used in application and research. The Indium gallium zinc oxide (IGZO) thin film transistor possesses high mobility and good device stability and can reduce the complexity of scan driving circuit. With the high mobility of the IGZO thin film transistor, the size of the thin film transistor in the scan driving circuit is relatively small, which facilitates the manufacture of the narrow frame display device. However, the use of the scan driving circuit in the current display device, that is, the existing thin-film transistor display device array process can be utilized to manufacture the scan driving circuit on the array substrate to achieve the scan driving row by row, which allows each driving unit only drives one scan line. Thus, a plurality of scan lines are arranged in the general display device and a plurality of driving units are required for design. The circuit becomes complicated and space is occupied, which is not conductive to the narrow frame design of the display device.

SUMMARY OF THE INVENTION

An objective of the present invention is to provide a scan driving circuit and a display device, which can simplify the circuit and save the space, thus being beneficial for the narrow frame design of the display device.

For solving the aforesaid technical issue, a technical solution employed by the present invention is: providing a scan driving circuit, comprising:

a driving circuit, comprising a plurality of driving units connected in turn, wherein each of the driving units is correspondingly connected to a multiplexing circuit, each of the driving units comprises a first signal input end, a second signal input end, a first signal output end and a second signal output end, the first signal input end is employed to receive a trigger signal or a former stage scan signal, the second signal input end is employed to receive a latter stage scan signal, the first signal output end and the second signal output end are connected to the multiplexing circuit; and the multiplexing circuit, comprising a plurality of multiplexing units, wherein each of the multiplexing units comprises first to fifth signal receiving ends and a scan signal output end, the first signal receiving end is connected to the first signal output end of the driving unit, the second signal receiving end is connected to the second signal output end of the driving unit, the third signal receiving end is employed to receive a former stage scan signal, the fourth signal receiving end is employed to receive a latter stage scan signal, the fifth signal receiving end is employed to receive a clock signal, the scan signal output end is employed to output a scan signal to a scan line for driving a pixel unit;

wherein each of the driving unit comprises first to fifth controllable switches and a first capacitor, a control end of the first controllable switch is connected to the first signal input end, a first end of the first controllable switch is connected to a voltage end, a second end of the first controllable switch is connected to a control end of the third controllable switch, a first end of the fourth controllable switch, a first end of the fifth controllable switch and the first signal output end, a control end of the second controllable switch is connected to a first end of the second controllable switch and the voltage end, a second end of the second controllable switch is connected to the second signal output end, a first end of the third controllable switch and a control end of the fourth controllable switch, second ends of the third to fifth controllable switches are all grounded, a control end of the fifth controllable switch is connected to the second signal input end, one end of the first capacitor is connected to a first end of the fifth controllable switch, the other end of the first capacitor is grounded;

a voltage level of an output signal of the first signal output end of the driving unit is opposite to a voltage level of an output signal of the second signal output end.

For solving the aforesaid technical issue, a technical solution employed by the present invention is: providing a scan driving circuit, comprising:

a driving circuit, comprising a plurality of driving units connected in turn, wherein each of the driving units is correspondingly connected to a multiplexing circuit, each of the driving units comprises a first signal input end, a second signal input end, a first signal output end and a second signal output end, the first signal input end is employed to receive a trigger signal or a former stage scan signal, the second signal input end is employed to receive a latter stage scan signal, the first signal output end and the second signal output end are connected to the multiplexing circuit; and the multiplexing circuit, comprising a plurality of multiplexing units, wherein each of the multiplexing units comprises first to fifth signal receiving ends and a scan signal output end, the first signal receiving end is connected to the first signal output end of the driving unit, the second signal receiving end is connected to the second signal output end of the driving unit, the third signal receiving end is employed to receive a former stage scan signal, the fourth signal receiving end is employed to receive a latter stage scan signal, the fifth signal receiving end is employed to receive a clock signal, the scan signal output end is employed to output a scan signal to a scan line for driving a pixel unit.

For solving the aforesaid technical issue, a technical solution employed by the present invention is: providing a display device, comprising a scan driving circuit, wherein the scan driving circuit comprises:

a driving circuit, comprising a plurality of driving units connected in turn, wherein each of the driving units is correspondingly connected to a multiplexing circuit, each of the driving units comprises a first signal input end, a second signal input end, a first signal output end and a second signal output end, the first signal input end is employed to receive a trigger signal or a former stage scan signal, the second signal input end is employed to receive a latter stage scan signal, the first signal output end and the second signal output end are connected to the multiplexing circuit; and the multiplexing circuit, comprising a plurality of multiplexing units, wherein each of the multiplexing units comprises first to fifth signal receiving ends and a scan signal output end, the first signal receiving end is connected to the first signal output end of the driving unit, the second signal receiving end is connected to the second signal output end of the driving unit, the third signal receiving end is employed to receive a former stage scan signal, the fourth signal receiving end is employed to receive a latter stage scan signal, the fifth signal receiving end is employed to receive a clock signal, the scan signal output end is employed to output a scan signal to a scan line for driving a pixel unit.

The benefits of the present invention are: different from the condition of prior arts, in the scan driving circuit and the display device of the present invention, the driving circuit is connected to one multiplexing circuit via one driving unit. One driving unit can drive a plurality of scan signal output ends to output scan signals with the plurality of the multiplexing units in the multiplexing circuit to simplify the circuit and save the space, thus being beneficial for the narrow frame design of the display device.

DETAILED DESCRIPTION OF PREFERRED EMBODIMENTS

Figure 1:
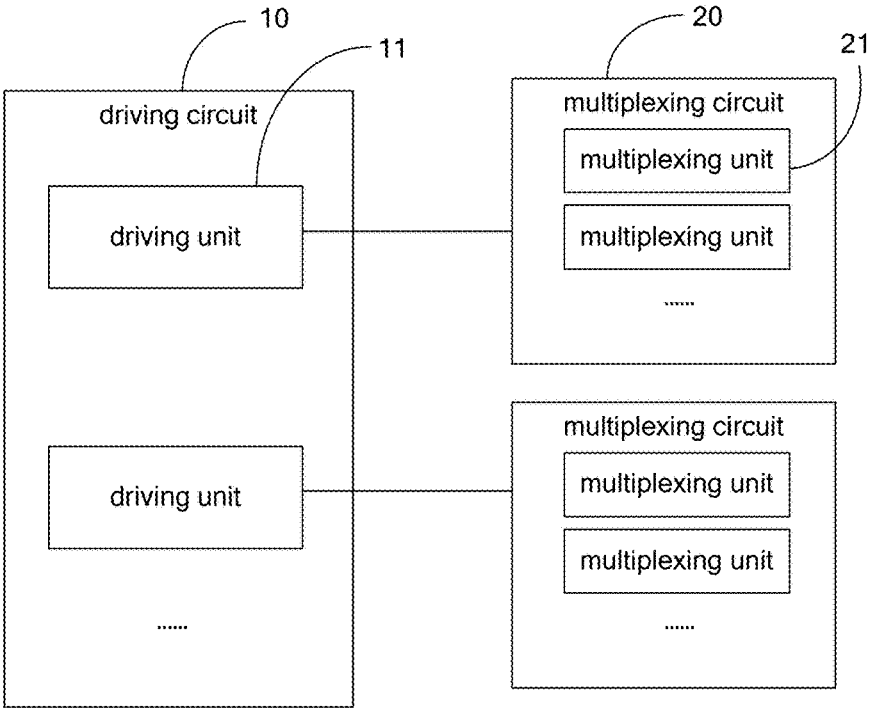
FIG. 1 is a structure diagram of a scan driving circuit of the present invention.

Please refer to FIG. 1, which is a structure diagram of a scan driving circuit of the present invention. The scan driving circuit comprises a driving circuit 10, the driving circuit 10 comprises a plurality of driving units 11 connected in turn, wherein each of the driving units 11 is correspondingly connected to a multiplexing circuit 20, each of the driving units 11 comprises a first signal input end, a second signal input end, a first signal output end GM(K) and a second signal output end QGM(K), the first signal input end is employed to receive a trigger signal STV or a former stage scan signal G(N−1), the second signal input end is employed to receive a latter stage scan signal G(N+6), the first signal output end GM(K) and the second signal output end QGM (K) are connected to the multiplexing circuit 20;

the multiplexing circuit 20 comprises a plurality of multiplexing units 21, wherein each of the multiplexing units 21 comprises first to fifth signal receiving ends and a scan signal output end G(N), the first signal receiving end is connected to the first signal output end GM(K) of the driving unit 11, the second signal receiving end is connected to the second signal output end QGM(K) of the driving unit 11, the third signal receiving end is employed to receive the former stage scan signal G(N−2), the fourth signal receiving end is employed to receive the latter stage scan signal G(N+3), the fifth signal receiving end is employed to receive a clock signal CK, the scan signal output end G(N) is employed to output a scan signal to a scan line for driving a pixel unit.

Figure 2:
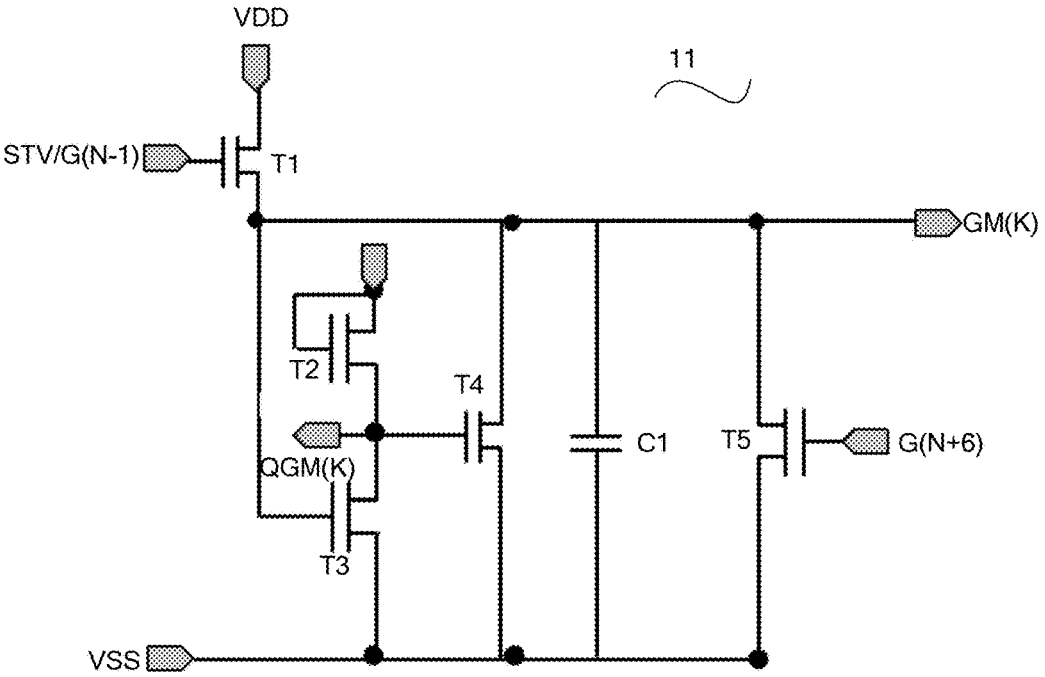
FIG. 2 is a circuit diagram of every driving unit of a driving circuit in FIG. 1.

Please refer to FIG. 2. Each of the driving units 11 comprises first to fifth controllable switches T1 to T5 and a first capacitor C1, a control end of the first controllable switch T1 is connected to the first signal input end, a first end of the first controllable switch T1 is connected to a voltage end, a second end of the first controllable switch T1 is connected to a control end of the third controllable switch T3, a first end of the fourth controllable switch T4, a first end of the fifth controllable switch T5 and the first signal output end GM(K), a control end of the second controllable T2 switch is connected to a first end of the second controllable switch T2 and the voltage end VDD, a second end of the second controllable switch T2 is connected to the second signal output end QGM(K), a first end of the third controllable switch T3 and a control end of the fourth controllable switch T4, second ends of the third to fifth controllable switches T3-T5 are all grounded, a control end of the fifth controllable switch T5 is connected to the second signal input end, one end of the first capacitor C1 is connected to a first end of the fifth controllable switch T5, the other end of the first capacitor C1 is grounded.

Figure 3:
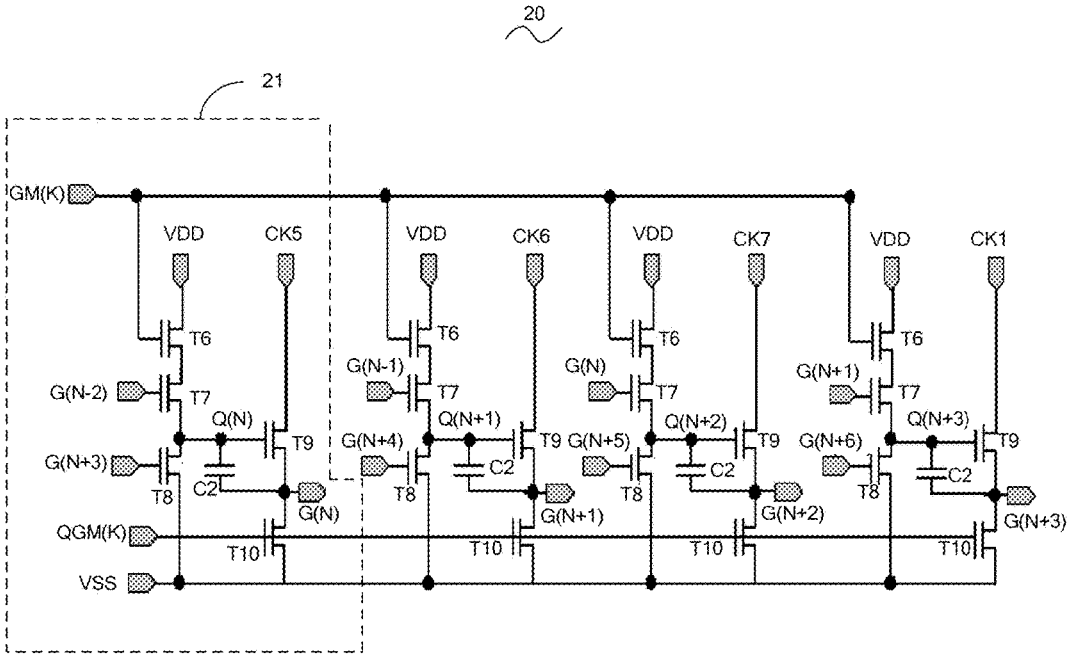
FIG. 3 is a circuit diagram of a multiplexing circuit in FIG. 1.
Figure 4:
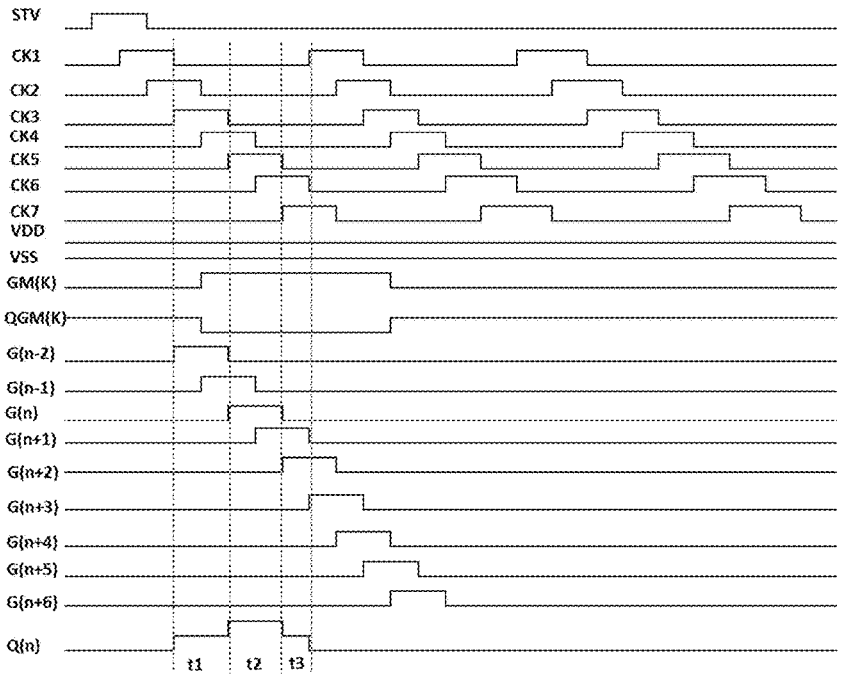
FIG. 4 is a waveform diagram of a scan driving circuit of the present invention.
Figure 5:
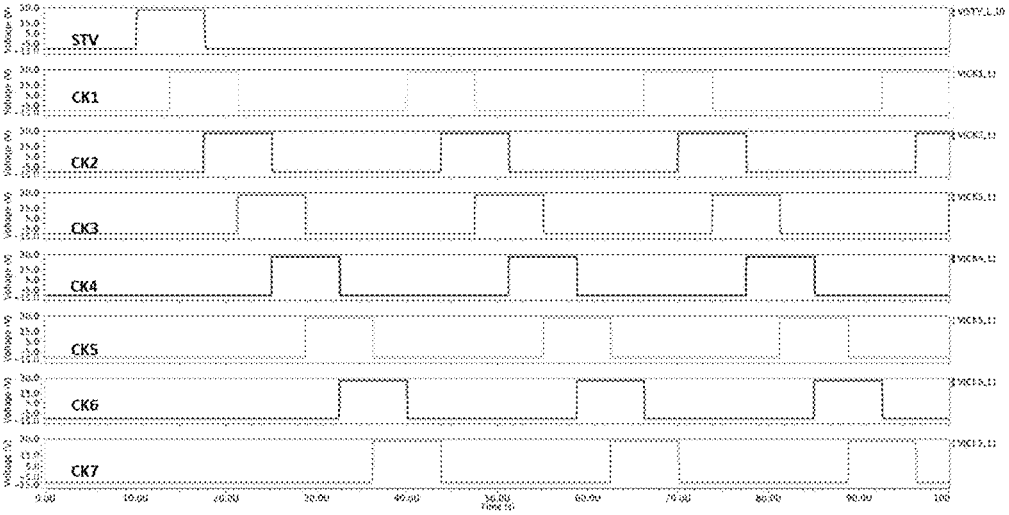
FIG. 5 is an emulational waveform diagram of a scan driving circuit of the present invention.
Figure 6:
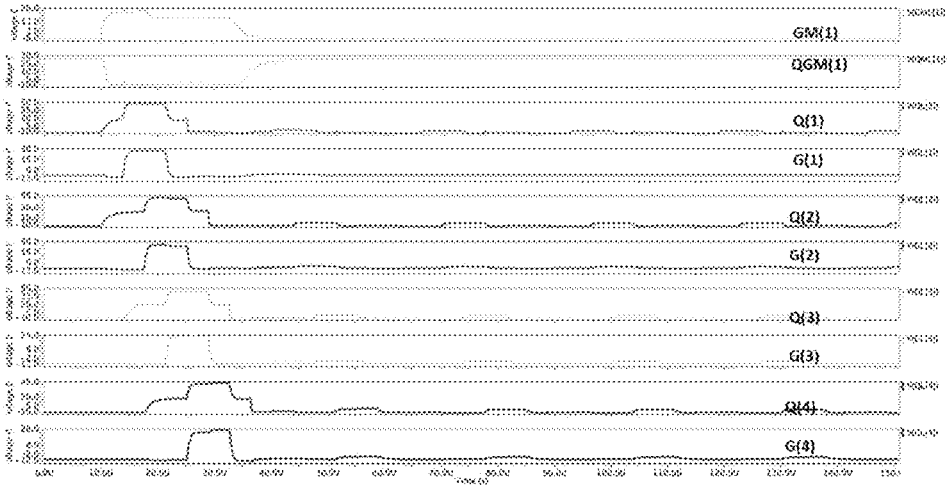
FIG. 6 is a waveform diagram of first four driving units of the scan driving circuit of the present invention.

Please refer to FIG. 3. Each of the multiplexing units 21 comprises sixth to tenth controllable switches T6-T10 and a second capacitor C2, a control end of the sixth controllable switch T6 is connected to the first signal receiving end, a first end of the sixth controllable switch T6 is connected to the voltage end VDD, a second end of the sixth controllable switch T6 is connected to a first end of the seventh controllable switch T7, a control end of the seventh controllable switch T7 is connected to the third signal receiving end, a second end of the seventh controllable switch T7 is connected to a first end of the eighth controllable switch T8 and a control end of the ninth controllable switch T9, a control end of the eighth controllable switch T8 is connected to the fourth signal receiving end, a second end of the eighth controllable switch T8 is grounded, a first end of the ninth controllable switch T9 is connected to the fifth signal receiving end, a second end of the ninth controllable switch T9 is connected to a first end of the tenth controllable switch T10 and the scan signal output end G(N), a control end of the tenth controllable switch T10 is connected to the second signal receiving end, a second end of the tenth controllable switch T10 is grounded, one end of the second capacitor C2 is connected to the control end of the ninth controllable switch T9, the other end of the second capacitor C2 is connected to the second end of the ninth controllable switch T9.

In this embodiment, the first to tenth controllable switches T1 to T10 are all N type thin film transistors, the control ends, the first ends and the second ends of the first to tenth controllable switches T1 to T10 respectively are gates, sources and drains of the N type thin film transistors. In other embodiments, the first to tenth controllable switches may be switches of other types as long as the objective of the present invention can be achieved.

In this embodiment, a voltage level of an output signal of the first signal output end GM(K) of the driving unit 11 is opposite to a voltage level of an output signal of the second signal output end QGM(K). The trigger signal STV is an alternating current. The pulse width is 2H time (H is the time corresponding to data). The high voltage level is VGH and the low voltage level is VGL. The trigger signal STV is supplied to the first signal input end of the first stage driving unit 11 of the driving circuit 10. The first signal input ends of the driving units 11 of the other stages receive the former stage scan signal G(N−1). The voltage end VDD is a high voltage direct current and the voltage level is VGH. The pulse width of the clock signal CK is 2H. The period is 7H. The interval between the two clock signals is 1 H. The interval between the clock signal CK and the trigger signal STV is 1 H. The high voltage of the clock signal CK is VGH and the low voltage level of the clock signal is VGL.

Please refer to FIG. 1 to FIG. 6. The operation of the scan driving circuit is described below. Here, the operation state of the scan driving circuit is explained with the scan signal output end G(n). Assuming that the scan signal output end G(n) is controlled by the clock signal CK5. The clock signals CK5, CK6, CK7 and CK1 are clock signals of the same phase. The scan driving circuit requires seven clock signals CK. Namely, CK1 to CK7 are followed by loop in turn. Each clock signal CK controls one scan signal output end.

First, the working state of the Kth stage scan driving circuit is as follows: when the former stage scan signal G(N−1) received by the first signal input end is at a high voltage level, the first controllable switch T1 is on, the first signal output end GM(K) outputs a high voltage level and the third controllable switch T3 is on. Due to the resistance divider of the second controllable switch T2 and the third controllable switch T3, the voltage level of the second signal output end QGM(K) is a low voltage level of the grounded end VSS. When the latter stage scan signal G(N+6) received by the second signal input end is at a high voltage level, the fifth controllable switch T5 is on and the high voltage level of the first signal output end GM(K) is pulled down to a low voltage level by the grounded end VSS. Then, the third controllable switch T3 is off and the control end of the second controllable switch T2 constantly receives a high voltage level of the voltage end VDD has been on. Then, the voltage level of the second voltage output end QGM(K) is a high voltage level of the voltage end VDD. The operating status of the other driving units is the same as described above and will not be repeated here.

Second, the working state of the multiplexing circuit 20 is as follows: when the signal of the first signal output end GM(K) received by the first signal receiving end is a high voltage level, the sixth controllable switch T6 is on, a high voltage level of the voltage end VDD is provided to the seventh controllable switch T7 via the sixth controllable switch T6; when the former stage scan signal G(N−2) received by the third signal receiving end is a high voltage level, the seventh controllable switch T7 is on, the high voltage level of the voltage end VDD is provided to the pull up control signal point Q(N) via the seventh controllable switch T7, a voltage level of the pull up control signal point Q(N) is changed to be a high voltage level VGH and the ninth controllable switch T9 is on; when the clock signal CK5 received by the fifth signal receiving end is a high voltage level, a voltage level of the scan signal output end G(N) is the high voltage level of the clock signal CK5. Meanwhile, both the former stage scan signal G(N−2) received by the third signal receiving end and the latter stage scan signal G(N+3) received by the fourth signal receiving end are low voltage levels, the seventh controllable switch T7 and the eighth controllable switch T8 are both off. The voltage level of the pull up control signal point Q(N) is raised to be a higher voltage level due to the bootstrap function of the second capacitor C2, thus the ninth controllable switch T9 is completely on, the high voltage level of the clock signal CK5 received by the fifth signal receiving end can be transmitted to the scan signal output end G(N) more rapidly to obtain a better waveform output; when the signal from the second signal output end QGM(K) received by the second signal receiving end is a high voltage level, the tenth controllable switch T10 is on and a voltage level of the scan signal output end G(N) is pulled down to a low voltage level of the grounded end VSS; when the latter stage scan signal G(N+3) received by the fourth signal receiving end is a high voltage level, the eighth controllable switch T8 is on and the voltage level of the pull up control signal point Q(N) is pulled down to be a low voltage level of the grounded end VSS to prevent that the scan signal output end outputs a plurality of waveforms due to the high voltage level of the pull up control signal point Q(N). The operating status of the other multiplexing units is the same as described above and will not be repeated here.

Figure 7:
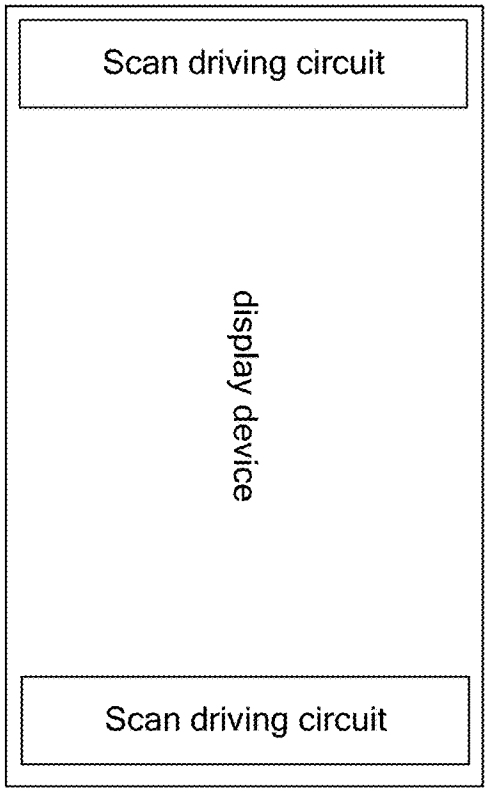
FIG. 7 is a structure diagram of a display device of the present invention.

Please refer to FIG. 7, which is a structure diagram of a display device of the present invention. The display device comprises the aforesaid scan driving circuit. The scan driving circuit is arranged on the left and right sides of the display device. The display device is an LCD or an OLED. The other components and functions of the display device are the same as the components and functions of the display device of prior art and will not be repeated here.

In the scan driving circuit and the display device, the driving circuit is connected to one multiplexing circuit via one driving unit. One driving unit can drive a plurality of scan signal output ends to output scan signals with the plurality of the multiplexing units in the multiplexing circuit to simplify the circuit and save the space, thus being beneficial for the narrow frame design of the display device.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A scan driving circuit, comprising:

a driving circuit, comprising a plurality of driving units connected in turn, wherein each of the driving units is correspondingly connected to a multiplexing circuit, each of the driving units comprises a first signal input end, a second signal input end, a first signal output end and a second signal output end, the first signal input end is employed to receive a trigger signal or a former stage scan signal, the second signal input end is employed to receive a latter stage scan signal, the first signal output end and the second signal output end are connected to the multiplexing circuit; and the multiplexing circuit, comprising a plurality of multiplexing units, wherein each of the multiplexing units comprises first to fifth signal receiving ends and a scan signal output end, the first signal receiving end is connected to the first signal output end of the driving unit, the second signal receiving end is connected to the second signal output end of the driving unit, the third signal receiving end is employed to receive a former stage scan signal, the fourth signal receiving end is employed to receive a latter stage scan signal, the fifth signal receiving end is employed to receive a clock signal, the scan signal output end is employed to output a scan signal to a scan line for driving a pixel unit;

wherein each of the driving unit comprises first to fifth controllable switches and a first capacitor, a control end of the first controllable switch is connected to the first signal input end, a first end of the first controllable switch is connected to a voltage end, a second end of the first controllable switch is connected to a control end of the third controllable switch, a first end of the fourth controllable switch, a first end of the fifth controllable switch and the first signal output end, a control end of the second controllable switch is connected to a first end of the second controllable switch and the voltage end, a second end of the second controllable switch is connected to the second signal output end, a first end of the third controllable switch and a control end of the fourth controllable switch, second ends of the third to fifth controllable switches are all grounded, a control end of the fifth controllable switch is connected to the second signal input end, one end of the first capacitor is connected to a first end of the fifth controllable switch, the other end of the first capacitor is grounded;

a voltage level of an output signal of the first signal output end of the driving unit is opposite to a voltage level of an output signal of the second signal output end.

2. A scan driving circuit, comprising:

a driving circuit, comprising a plurality of driving units connected in turn, wherein each of the driving units is correspondingly connected to a multiplexing circuit, each of the driving units comprises a first signal input end, a second signal input end, a first signal output end and a second signal output end, the first signal input end is employed to receive a trigger signal or a former stage scan signal, the second signal input end is employed to receive a latter stage scan signal, the first signal output end and the second signal output end are connected to the multiplexing circuit; and the multiplexing circuit, comprising a plurality of multiplexing units, wherein each of the multiplexing units comprises first to fifth signal receiving ends and a scan signal output end, the first signal receiving end is connected to the first signal output end of the driving unit, the second signal receiving end is connected to the second signal output end of the driving unit, the third signal receiving end is employed to receive a former stage scan signal, the fourth signal receiving end is employed to receive a latter stage scan signal, the fifth signal receiving end is employed to receive a clock signal, the scan signal output end is employed to output a scan signal to a scan line for driving a pixel unit;

wherein each of the driving unit comprises first to fifth controllable switches and a first capacitor, a control end of the first controllable switch is connected to the first signal input end, a first end of the first controllable switch is connected to a voltage end, a second end of the first controllable switch is connected to a control end of the third controllable switch, a first end of the fourth controllable switch, a first end of the fifth controllable switch and the first signal output end, a control end of the second controllable switch is connected to a first end of the second controllable switch and the voltage end, a second end of the second controllable switch is connected to the second signal output end, a first end of the third controllable switch and a control end of the fourth controllable switch, second ends of the third to fifth controllable switches are all grounded, a control end of the fifth controllable switch is connected to the second signal input end, one end of the first capacitor is connected to a first end of the fifth controllable switch, the other end of the first capacitor is grounded.

3. The scan driving circuit according to claim 2, wherein each of the multiplexing units comprises sixth to tenth controllable switches and a second capacitor, a control end of the sixth controllable switch is connected to the first signal receiving end, a first end of the sixth controllable switch is connected to the voltage end, a second end of the sixth controllable switch is connected to a first end of the seventh controllable switch, a control end of the seventh controllable switch is connected to the third signal receiving end, a second end of the seventh controllable switch is connected to a first end of the eighth controllable switch and a control end of the ninth controllable switch, a control end of the eighth controllable switch is connected to the fourth signal receiving end, a second end of the eighth controllable switch is grounded, a first end of the ninth controllable switch is connected to the fifth signal receiving end, a second end of the ninth controllable switch is connected to a first end of the tenth controllable switch and the scan signal output end, a control end of the tenth controllable switch is connected to the second signal receiving end, a second end of the tenth controllable switch is grounded, one end of the second capacitor is connected to the control end of the ninth controllable switch, the other end of the second capacitor is connected to the second end of the ninth controllable switch.

4. The scan driving circuit according to claim 3, wherein the first to tenth controllable switches are all N type thin film transistors, the control ends, the first ends and the second ends of the first to tenth controllable switches respectively are gates, sources and drains of the N type thin film transistors.

5. The scan driving circuit according to claim 2, wherein a voltage level of an output signal of the first signal output end of the driving unit is opposite to a voltage level of an output signal of the second signal output end.

6. A display device, comprising a scan driving circuit, wherein the scan driving circuit comprises:

a driving circuit, comprising a plurality of driving units connected in turn, wherein each of the driving units is correspondingly connected to a multiplexing circuit, each of the driving units comprises a first signal input end, a second signal input end, a first signal output end and a second signal output end, the first signal input end is employed to receive a trigger signal or a former stage scan signal, the second signal input end is employed to receive a latter stage scan signal, the first signal output end and the second signal output end are connected to the multiplexing circuit; and the multiplexing circuit, comprising a plurality of multiplexing units, wherein each of the multiplexing units comprises first to fifth signal receiving ends and a scan signal output end, the first signal receiving end is connected to the first signal output end of the driving unit, the second signal receiving end is connected to the second signal output end of the driving unit, the third signal receiving end is employed to receive a former stage scan signal, the fourth signal receiving end is employed to receive a latter stage scan signal, the fifth signal receiving end is employed to receive a clock signal, the scan signal output end is employed to output a scan signal to a scan line for driving a pixel unit;

wherein each of the driving unit comprises first to fifth controllable switches and a first capacitor, a control end of the first controllable switch is connected to the first signal input end, a first end of the first controllable switch is connected to a voltage end, a second end of the first controllable switch is connected to a control end of the third controllable switch, a first end of the fourth controllable switch, a first end of the fifth controllable switch and the first signal output end, a control end of the second controllable switch is connected to a first end of the second controllable switch and the voltage end, a second end of the second controllable switch is connected to the second signal output end, a first end of the third controllable switch and a control end of the fourth controllable switch, second ends of the third to fifth controllable switches are all grounded, a control end of the fifth controllable switch is connected to the second signal input end, one end of the first capacitor is connected to a first end of the fifth controllable switch, the other end of the first capacitor is grounded.

7. The display device according to claim 6, wherein each of the multiplexing units comprises sixth to tenth controllable switches and a second capacitor, a control end of the sixth controllable switch is connected to the first signal receiving end, a first end of the sixth controllable switch is connected to the voltage end, a second end of the sixth controllable switch is connected to a first end of the seventh controllable switch, a control end of the seventh controllable switch is connected to the third signal receiving end, a second end of the seventh controllable switch is connected to a first end of the eighth controllable switch and a control end of the ninth controllable switch, a control end of the eighth controllable switch is connected to the fourth signal receiving end, a second end of the eighth controllable switch is grounded, a first end of the ninth controllable switch is connected to the fifth signal receiving end, a second end of the ninth controllable switch is connected to a first end of the tenth controllable switch and the scan signal output end, a control end of the tenth controllable switch is connected to the second signal receiving end, a second end of the tenth controllable switch is grounded, one end of the second capacitor is connected to the control end of the ninth controllable switch, the other end of the second capacitor is connected to the second end of the ninth controllable switch.

8. The display device according to claim 7, wherein the first to tenth controllable switches are all N type thin film transistors, the control ends, the first ends and the second ends of the first to tenth controllable switches respectively are gates, sources and drains of the N type thin film transistors.

9. The display device according to claim 6, wherein a voltage level of an output signal of the first signal output end of the driving unit is opposite to a voltage level of an output signal of the second signal output end.

* * * * *